US011459915B2

(12) United States Patent
Schnell et al.

(10) Patent No.: US 11,459,915 B2
(45) Date of Patent: Oct. 4, 2022

(54) HYDRAULIC SUPPORT ELEMENT

(71) Applicant: Schaeffler Technologies AG & Co. KG, Herzogenaurach (DE)

(72) Inventors: Oliver Schnell, Veitsbronn (DE); Peter Sailer, Erlangen (DE); Oliver Witter, Westhausen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 286 days.

(21) Appl. No.: 16/619,238

(22) PCT Filed: Apr. 5, 2018

(86) PCT No.: PCT/DE2018/100307
§ 371 (c)(1),
(2) Date: Dec. 4, 2019

(87) PCT Pub. No.: WO2018/224074
PCT Pub. Date: Dec. 13, 2018

(65) Prior Publication Data

US 2020/0123936 A1 Apr. 23, 2020

(30) Foreign Application Priority Data

Jun. 7, 2017 (DE) ..... 10 2017 112 468.3

(51) Int. Cl.
*F01L 1/24* (2006.01)
*F01L 1/245* (2006.01)
(Continued)

(52) U.S. Cl.
CPC ..... *F01L 1/2405* (2013.01); *F01L 1/245* (2013.01); *F01L 1/146* (2013.01); *F01L 1/185* (2013.01);
(Continued)

(58) Field of Classification Search
CPC ..... F01L 2303/00; F01L 13/0005; F01L 2001/34426; F01L 1/2405; F01L 1/245; F01L 1/24; F01L 1/146; F01L 1/185
(Continued)

(56) References Cited

U.S. PATENT DOCUMENTS 2,246,330 A 6/1941 Voorhies
2,570,622 A 10/1951 Willis
(Continued)

FOREIGN PATENT DOCUMENTS

CN 205445707 U 8/2016
CN 205477800 U 8/2016
(Continued)

*Primary Examiner* — Devon C Kramer
*Assistant Examiner* — Kelsey L Stanek

(57) ABSTRACT

This disclosure relates to a hydraulic support element for a switchable rocker arm of a valve train of an internal combustion engine. The hydraulic support element includes a cup-shaped cylinder, within which a hollow piston is arranged in an axially displaceable manner. The piston includes a filter cartridge which is in the form of a hollow body and can be charged from the outside with pressurized oil and an interior space of which is connected to an outlet opening of the contact head. An interior space of the piston has two pressurized oil chambers, including a first pressurized oil chamber above the piston head and connected to a first pressurized oil feed, and a second pressurized oil chamber formed under the contact head and connected to a second pressurized oil feed. The filter cartridge is tubular and located in the second pressurized oil chamber.

16 Claims, 2 Drawing Sheets

(51) Int. Cl.

| | |
|---|---|
| *F01L 1/14* | (2006.01) |
| *F01L 1/18* | (2006.01) |
| *F01L 13/00* | (2006.01) |
| *F01L 1/344* | (2006.01) |

(52) U.S. Cl.
CPC . *F01L 13/0005* (2013.01); *F01L 2001/34426* (2013.01); *F01L 2303/00* (2020.05)

(58) Field of Classification Search
USPC ..... 123/90.55
See application file for complete search history.

(56) References Cited

U.S. PATENT DOCUMENTS

| | | | | |
|---|---|---|---|---|
| 3,913,538 | A * | 10/1975 | Ableitner | F01L 1/2405 123/90.46 |
| 8,127,790 | B2 | 3/2012 | Van Weelden et al. | |
| 8,186,378 | B2 | 5/2012 | Nordstrom et al. | |
| 2008/0190391 | A1* | 8/2008 | McElwee | F01L 1/2411 123/90.55 |
| 2009/0217896 | A1* | 9/2009 | Schnell | C23C 16/26 123/90.51 |
| 2015/0053174 | A1* | 2/2015 | Nishimoto | F02D 41/1498 123/346 |
| 2017/0002703 | A1* | 1/2017 | Khadilkar | F01M 1/12 |

FOREIGN PATENT DOCUMENTS

| | | | | |
|---|---|---|---|---|
| CN | 106471224 | A | 3/2017 | |
| CN | 206233966 | U | 6/2017 | |
| DE | 10020117 | A1 | 10/2001 | |
| DE | 102004033500 | A1 | 2/2006 | |
| DE | 102011101239 | A1 | 11/2012 | |
| DE | 102015221038 | A1 * | 8/2016 | F01L 1/24 |
| DE | 102015221038 | A1 | 8/2016 | |
| EP | 1785595 | A1 | 5/2007 | |
| FR | 2910529 | A3 | 6/2008 | |
| RU | 2231650 | C2 | 6/2004 | |

* cited by examiner

HYDRAULIC SUPPORT ELEMENT

CROSS REFERENCE TO RELATED APPLICATIONS

This application is the U.S. National Phase of PCT Application No. PCT/DE2018/100307 filed on Apr. 5, 2018 which claims priority to DE 10 2017 112 468.3 filed on Jun. 7, 2017, the entire disclosures of which are incorporated by reference herein.

TECHNICAL FIELD

This disclosure relates to a hydraulic support element for a switchable finger follower of a valve train of an internal combustion engine. The hydraulic support element includes a cup-shaped cylinder with a base arranged at the cylinder end, in which cylinder a hollow piston is arranged in an axially movable manner. The piston includes a piston head facing the base, and, at a free axial end thereof, a contact head for the finger follower. An interior space of the piston is fluidly connectable to a pressurized oil supply and is fluidly connected to an outlet opening formed in the contact head. The piston has a filter cartridge in the form of a hollow body, which can be charged from the outside with pressurized oil and the interior space of which is fluidly connected to the outlet opening of the contact head.

BACKGROUND

In the case of switchable finger followers (see EP 1 785 595 A1, for example), the support element is usually of double-flow design, for which purpose the interior space of the piston is divided into two pressurized oil chambers, each with a dedicated pressurized oil feed. One of the two pressurized oil chambers supplies the high-pressure chamber and the other pressurized oil chamber supplies the contact head with pressurized oil, which, in addition to its lubricating function, facilitates actuation of the switchable finger follower into two switching positions.

It has been found that despite main and bypass flow filtering of the oil, contaminants get into the oil circuit of the internal combustion engine or may be present in the form of products of aging, such as soot and abraded metal, contained in the hydraulic oil. This can lead to damage caused by the oil fed to the contact head since lubrication of the contact surfaces is impaired, or it can lead to jamming of a locking mechanism arranged in the switchable finger follower and thus to the failure of the switching function.

FR 2 910 529 A1, FIG. 4, discloses a single-flow hydraulic support element in which an annular filter is arranged in the region of the pressurized oil supply on the outer circumference of the solid piston. The possible filter area is extremely small, namely being restricted to the area of the supply opening covered by the filter. The pressurized oil chamber enclosed by the pressure piston is relatively small.

DE 100 20 117 A1 discloses the practice of installing a single-flow support element in a separate guide sleeve, for example, and inserting a mesh filter into a hydraulic medium passage provided in said sleeve. Apart from the associated technical complexity, it is considered to be a particular disadvantage that, in this solution, the possible filter area is limited to the area of the filter material covered by the passage and therefore that the possible filtering capacity is very low.

DE 10 2004 033 500 A1, FIG. 2, shows in a partial view a roller tappet which is designed for acting on a push rod and in the pressure piston of which, at the bottom of its cup-shaped contact piece for the push rod, there is seated a low-height filter ring, which is held on the inner circumferential surface of the pressure piston by means of an angled collar. In this case, the oil flows axially downward during operation via the push rod into the reservoir chamber enclosed by the pressure piston.

DE 10 2011 01 239 A1 discloses a support element in which, on the one hand, oil is supplied from the interior space of the piston, via a check valve in the head of the piston, to the high-pressure chamber used to hold the piston rigidly in the load phase and, on the other hand, oil is supplied from said space to the contact head via a line connecting the interior space to said head. A filter device that could retain contaminants in the lubricating oil before they reach the contact surfaces is not provided.

SUMMARY

It is the object of the disclosure to provide a hydraulic support element for a switchable finger follower which has very good filtering properties and does not have to be significantly modified in terms of design.

According to the disclosure, this object is achieved by virtue of the fact that the interior space of the piston has two pressurized oil chambers, which are separated from each other by means of a partition element. A first pressurized oil chamber lies above the piston head and is fluidly connected to a first pressurized oil feed, and a second pressurized oil chamber is formed under the contact head and is fluidly connected to a second pressurized oil feed. The filter cartridge is tubular and, in the second pressurized oil chamber, sealingly located on the partition element, via its first end facing the partition element. Additionally, the filter cartridge is fluidly connected via its second end to the outlet opening of the contact head.

Thus, in the double-flow support element according to the disclosure, the tubular filter cartridge is located in the second pressurized oil chamber of the interior space of the piston. This interior space contains the pressurized oil which is provided for lubricating the contact surfaces between the contact head and the finger follower and for switching the finger follower and which is to be kept free from contaminants and residues.

The second pressurized oil chamber offers sufficient space to accommodate a high-performance tubular filter without enlarging the outside diameter of the piston and hence of the support element. By means of a filter cartridge in the form of a hollow body which is charged with the pressurized oil from the outside, a maximum possible filter area can thus be achieved. By virtue of the measures according to the disclosure, the first end of the filter cartridge is closed, and therefore the pressurized oil enters the interior of the filter cartridge via the tubular filter surface and from there passes to the contact head.

A development of the filter cartridge envisages that the filter cartridge has a sealing collar at each of its two ends, wherein the sealing collar associated with the first end of the filter cartridge sits in a sealing manner on the partition element and the sealing collar associated with the second end of the filter cartridge sealingly located against the inner wall of the contact head.

According to another embodiment of the disclosure, it is envisaged that the filter cartridge is mounted by means of its first end on a tubular protuberance of the partition element, said protuberance being directed toward the second pressurized oil chamber, and that the second end carries a sealing sleeve, which is sealingly located against the inner wall of the contact head.

According to another embodiment of the disclosure, the partition element is provided with a restriction orifice, which fluidly connects the first pressurized oil chamber to the second pressurized oil chamber, in order to allow pressure equalization between the first pressurized oil chamber and the second pressurized oil chamber.

According to the disclosure, the pressurized oil feed to the pressurized oil chambers is made possible by the fact that the pressurized oil feeds for the pressurized oil chambers each comprise a feed opening, which is formed in the wall of the cylinder and can be fluidly connected to a pressurized oil line. Furthermore, the pressurized oil feeds can comprise at least one inlet opening formed in the wall of the hollow piston, and an annular space, which is formed in the region of these openings, between the wall of the cylinder and the wall of the piston. The annular space has an axial extent which ensures that there is a connection between the feed openings and the inlet openings in all possible piston positions.

BRIEF DESCRIPTION OF THE DRAWINGS

The disclosure is explained by means of illustrative embodiments. For this purpose, drawings are attached to the description. In the drawings.

DETAILED DESCRIPTION

Figure 1:
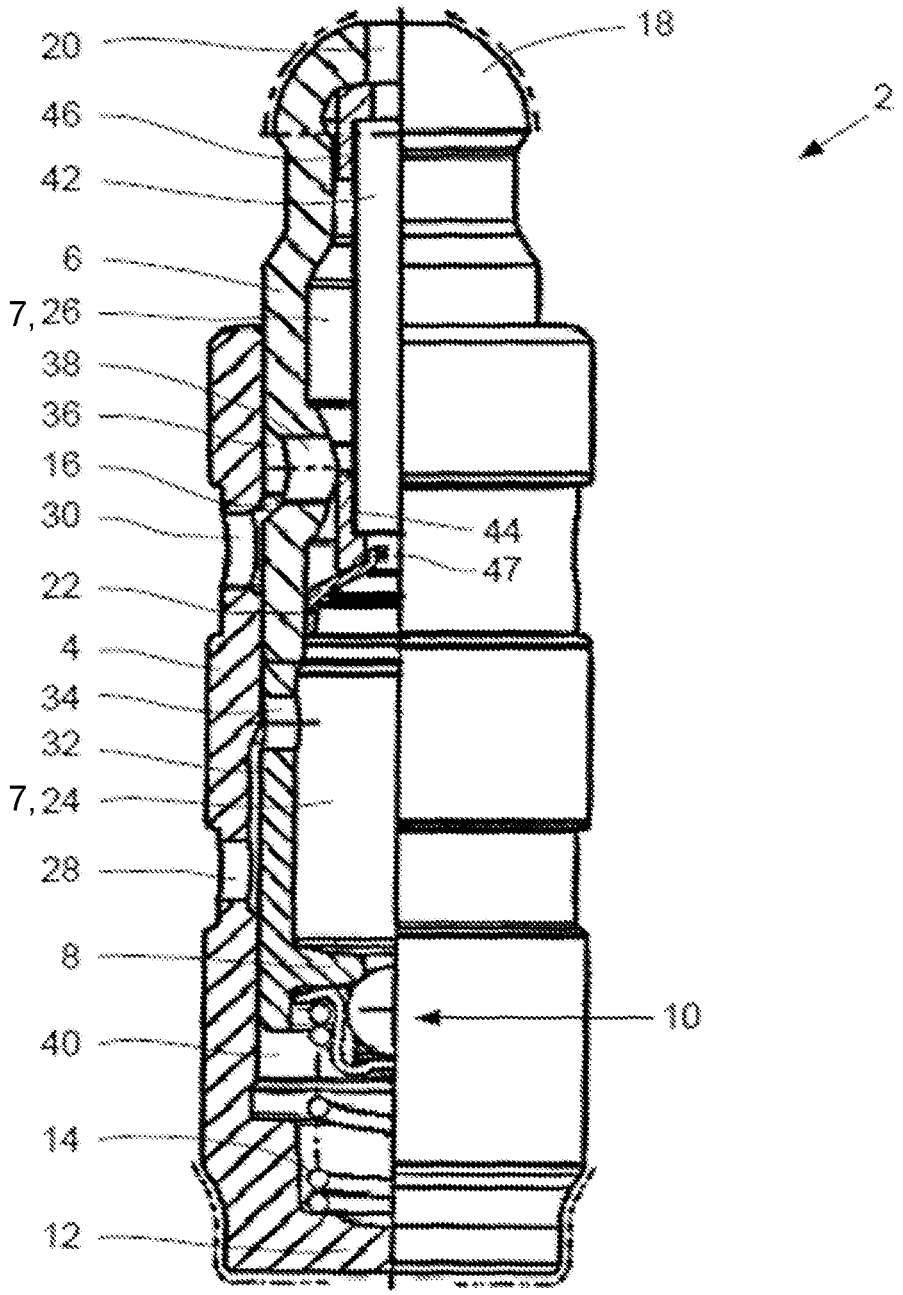
FIG. 1 shows a partial longitudinal section through a double-flow hydraulic support element having the features of the disclosure.

The hydraulic support element 2 illustrated in FIG. 1 has an outer cup-shaped cylinder 4 and a hollow piston 6, which can be moved axially in said cylinder. At its cylinder end, which is at the bottom in FIG. 1, the piston 6 has a piston head 8, on which a downward-opening, spring-loaded check valve 10 formed by a ball and an associated ball seat is arranged. A compression spring 14 resting against the piston head 8, on the one hand, and against the base 12 of the cylinder 4, on the other hand, loads the piston 6 in an upward direction, wherein the travel of the piston 6 in the upward direction is limited by a stop ring 16 arranged on the inside of the cylinder 4.

Formed on that end of the piston 6 which faces away from the piston head 8 is a contact head 18, which is intended to support a switchable finger follower (not illustrated). An outlet opening 20, which is fluidly connected to an interior space 7 of the piston 6, is formed in the contact head 18.

The interior 7 of the piston 6 is divided by means of a partition wall element 22 into a first pressurized oil chamber 24 associated with the piston head 8 and a second pressurized oil chamber 26 associated with the contact head 18. The two pressurized oil chambers 24, 26 each have dedicated pressurized oil feeds. For this purpose, there are two feed openings 28, 30, each connectable to pressurized oil supply lines (not illustrated), in the wall of the cylinder 4, wherein the first feed opening 28 is fluidly connected via an associated annular space 32, which is formed between the cylindrical wall of the cylinder 4 and the cylindrical wall of the piston 6, to an inlet opening 34, which is formed in the wall of the piston 6 and leads to the first pressurized oil chamber 24. The second feed opening 30 is fluidly connected via an associated annular space 36 to an inlet opening 38 leading to the second pressurized oil chamber 26.

When the support element 2 is subjected to axial loading, the piston 6 is held in a rigid manner by the pressurized oil present in the high-pressure chamber 40 situated below the piston head 8 and thus forms a rigid support for a finger follower. When the load is relieved, the piston 6 is loaded upward by the compression spring 14 and can draw additional oil into the high-pressure chamber 40 via the check valve 10 and thus compensate any lash with respect to the finger follower.

Arranged in the second pressurized oil chamber 26, which is associated with the contact head 18, is a tubular filter cartridge 42, the first axial end of which, which faces the partition element 22, is sealingly located on said partition wall 22 and the second, open end of which is fluidly connected to the outlet opening 20 of the contact head 18. For this purpose, the filter cartridge 42 has a sealing collar 44, 46 at each of its two ends, wherein the first sealing collar 44, that associated with the first end, is sealingly located on the partition element 22 and the second sealing collar 46, that associated with the second end, is sealingly located against the lateral inner wall of the contact head 18. During operation, the pressurized oil in the second pressurized oil chamber 26 acts on the filter cartridge 42 from radially on the outside to radially on the inside, and the filtered pressurized oil can emerge through the outlet opening 20 for the purpose of lubricating the contact surfaces and switching the switchable finger follower.

Figure 2:
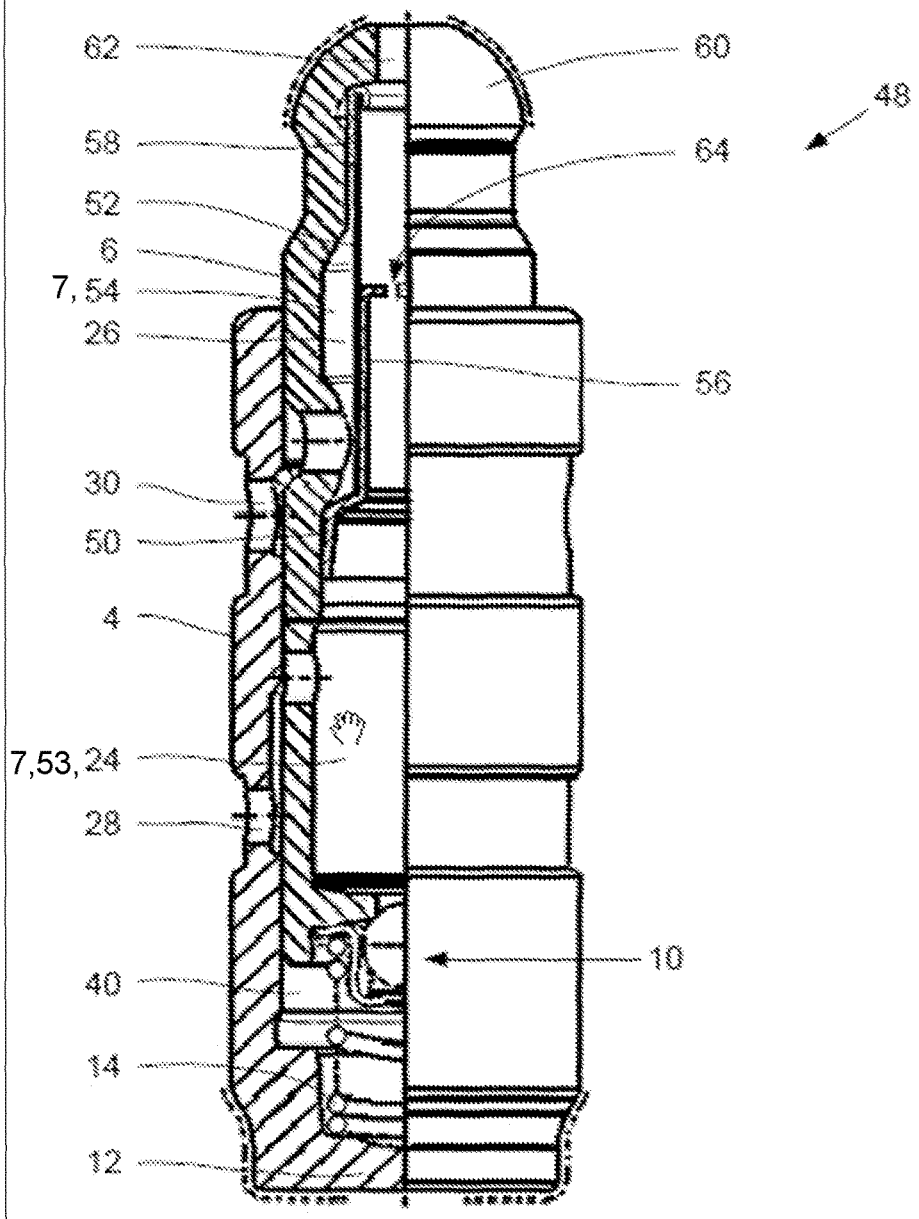
FIG. 2 shows a support element as per FIG. 1 in a different embodiment.

FIG. 2 shows a hydraulic support element 48, which is of substantially identical construction to the support element 2 in FIG. 1. It differs from the latter only in the geometry of the partition element 50 and of the filter cartridge 52 interacting with said element, and therefore the construction and operation of the actual support element does not need to be described in detail again.

Toward the second pressurized oil chamber 54, the partition element 50 shown in FIG. 2 has a tubular protuberance 56, on which the tubular filter cartridge 52 is mounted by means of its lower end in FIG. 2, thereby closing this end. The upper end of the filter cartridge 52 carries a sealing sleeve 58, which is sealingly located against the lateral inner wall of the contact head 60. Accordingly, the open upper end of the filter cartridge 52 is fluidly connected to the outlet opening 62 of the contact head 60, thereby providing lubrication of the contact surfaces between the contact head 60 and the finger follower and allowing the switching of said follower to be performed by means of filtered pressurized oil.

In both illustrative embodiments illustrated, the partition element 22, 50 is provided with a restriction orifice 47, 64, which fluidly connects the first pressurized oil chamber 24, 53 to the second pressurized oil chamber 26, 54 and allows pressure equalization.

REFERENCE CHARACTERS

2 hydraulic support element
4 cylinder
6 piston
7 interior space
8 piston head
10 check valve
12 base of cylinder
14 compression spring
16 stop ring
18 contact head

20 outlet opening
22 partition element
24 first pressurized oil chamber
26 second pressurized oil chamber
28 feed opening
30 feed opening
32 annular space
34 inlet opening
36 annular space
38 inlet opening
40 high-pressure chamber
42 filter cartridge
44 sealing collar
46 sealing collar
47 restriction orifice
48 hydraulic support element
50 partition element
52 filter cartridge
53 first pressurized oil chamber
54 second pressurized oil chamber
56 tubular protuberance
58 sealing sleeve
60 contact head
62 outlet opening
64 restriction orifice

The invention claimed is:

1. A hydraulic support element for a switchable finger follower of a valve train of an internal combustion engine, the hydraulic support element comprising:
- a cup-shaped cylinder with a base arranged at a cylinder end,
- a hollow piston arranged in an axially movable manner within the cup-shaped cylinder, the hollow piston having:
  - a piston head facing the base,
  - a contact head arranged at a free end of the hollow piston, the contact head configured to support the finger follower, and
  - an interior space fluidly connected to an outlet opening formed in the contact head,
  - a filter cartridge formed as a tubular body, the filter cartridge configured to be charged from outside the filter cartridge with pressurized oil and an interior space of the filter cartridge fluidly connected to the outlet opening of the contact head and,
  - the interior space of the hollow piston having a first pressurized oil chamber and a second pressurized oil chamber separated from each other by a partition element, the first pressurized oil chamber arranged above the piston head and fluidly connected to a first pressurized oil feed, and the second pressurized oil chamber formed under the contact head and fluidly connected to a second pressurized oil feed, and
  - a first end of the filter cartridge sealingly located on the partition element in the second pressurized oil chamber, and a second end of the filter cartridge fluidly connected to the outlet opening of the contact head.

2. The hydraulic support element as claimed in claim 1, wherein the filter cartridge has a sealing collar at each of its two ends, a first sealing collar associated with the first end of the filter cartridge is sealingly located on the partition element and a second sealing collar associated with the second end of the filter cartridge is sealingly located against an inner wall of the contact head.

3. The hydraulic support element as claimed in claim 1, wherein the filter cartridge is mounted by means of the first end on a tubular protuberance of the partition element, the protuberance being directed toward the second pressurized oil chamber, and the second end of the filter cartridge carries a sealing sleeve, which is sealingly located against an inner wall of the contact head.

4. The hydraulic support element as claimed in claim 1, wherein the partition element has a restriction orifice which connects the first pressurized oil chamber to the second pressurized oil chamber.

5. The hydraulic support element of claim 4, wherein the restriction orifice is arranged between the second pressurized oil feed and the contact head.

6. The hydraulic support element as claimed in claim 1, wherein the first and second pressurized oil feeds each comprise:
- a feed opening formed in a wall of the cylinder, the feed opening configured to be connected to a pressurized oil line,
- at least one inlet opening formed in a wall of the hollow piston, and
- an annular space formed between the wall of the cylinder and the wall of the hollow piston, the annular space having an axial extent that connects the feed opening and the at least one inlet opening.

7. A hydraulic support element for a switchable finger follower of a valve train of an internal combustion engine, the hydraulic support element comprising:
- a cup-shaped cylinder with a base arranged at a cylinder end,
- a hollow piston arranged in an axially movable manner within the cup-shaped cylinder, the hollow piston having:
  - a piston head facing the base,
  - a contact head arranged at a free end of the hollow piston, the contact head configured to support the finger follower, and
  - an interior space fluidly connected to an outlet opening formed in the contact head,
  - a filter cartridge formed as a tubular body disposed within the interior space, the filter cartridge configured to be charged from outside the filter cartridge with pressurized oil and an interior space of the filter cartridge fluidly connected to the outlet opening of the contact head and,
  - the interior space of the hollow piston having two pressurized oil chambers separated from each other by a partition element, a first end of the filter cartridge sealingly located on the partition element, and a second end of the filter cartridge fluidly connected to the outlet opening of the contact head.

8. The hydraulic support element of claim 7, wherein the filter cartridge is configured to be charged from outside the filter cartridge with pressurized oil from one of the two pressurized oil chambers formed between the contact head and the partition element.

9. The hydraulic support element as claimed in claim 7, wherein the partition element has a restriction orifice which connects the two pressurized oil chambers.

10. A hydraulic support element for a switchable finger follower of a valve train of an internal combustion engine, the hydraulic support element comprising:
- a cup-shaped cylinder with a base arranged at a cylinder end,
- a hollow piston arranged to move axially within the cup-shaped cylinder, the hollow piston having:
  - a piston head facing the base, a first pressurized oil chamber formed between the piston head and base, a contact head arranged at a free end of the hollow piston, the contact head configured to support the finger follower, and an interior space having a second pressurized oil chamber and a third pressurized oil chamber, the second pressurized oil chamber arranged between the first and third pressurized oil chambers, and a filter cartridge formed as a tubular body disposed within the third pressurized oil chamber, the filter cartridge configured to be charged from outside the filter cartridge with pressurized oil and an interior space of the filter cartridge fluidly connected to an outlet opening of the contact head.

11. The hydraulic support element of claim 10, wherein a length of the tubular body is greater than a diameter of the tubular body.

12. The hydraulic support element of claim 10, further comprising a check valve arranged between the first and second pressurized oil chambers.

13. The hydraulic support element of claim 12, wherein the first, second, and third pressurized oil chambers are fluidly connected with each other when the check valve is in an open state.

14. The hydraulic support element of claim 10, further comprising a first oil feed fluidly connected to: i) the second pressurized oil chamber; and, ii) the first pressurized oil chamber via the second pressurized oil chamber and a check valve, the check valve arranged between the first and second pressurized oil chambers.

15. The hydraulic support element of claim 14, further comprising a second oil feed fluidly connected to the third pressurized oil chamber.

16. The hydraulic support element of claim 15, wherein the second oil feed is arranged between the first oil feed and the outlet opening of the contact head.

* * * * *